US010140923B2

(12) United States Patent
Wang

(10) Patent No.: US 10,140,923 B2
(45) Date of Patent: Nov. 27, 2018

(54) PIXEL DRIVING SYSTEM OF AMOLED HAVING INITIALIZATION SIGNAL OF ALTERNATING HIGH AND LOW LEVELS AND METHOD FOR DRIVING PIXEL OF AMOLED HAVING INITIALIZATION SIGNAL OF ALTERNATING HIGH AND LOW LEVELS

(71) Applicant: Shenzhen China Star Optoelectronics Technology Co., Ltd., Shenzhen (CN)

(72) Inventor: Limin Wang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 39 days.

(21) Appl. No.: 15/509,199

(22) PCT Filed: Feb. 16, 2017

(86) PCT No.: PCT/CN2017/073725
§ 371 (c)(1),
(2) Date: Mar. 7, 2017

(87) PCT Pub. No.: WO2018/133144
PCT Pub. Date: Jul. 26, 2018

(65) Prior Publication Data

US 2018/0233085 A1 Aug. 16, 2018

(30) Foreign Application Priority Data

Jan. 20, 2017 (CN) ..... 2017 1 0042152

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01); *G09G 2320/045* (2013.01)

(58) Field of Classification Search
CPC ..... G09G 3/3258; G09G 3/3266; G09G 2320/045
(Continued)

(56) References Cited

U.S. PATENT DOCUMENTS

2010/0079361 A1* 4/2010 Lee ..... G09G 3/3233 345/77
2014/0062331 A1* 3/2014 Nam ..... G09G 3/3233 315/226
(Continued)

FOREIGN PATENT DOCUMENTS

CN 103700347 A 4/2014
CN 104751789 A 7/2015

*Primary Examiner* — Jonathan Blancha
(74) *Attorney, Agent, or Firm* — Leong C. Lei

(57) ABSTRACT

The present application provides a pixel driving system of AMOLED and a pixel driving method of AMOLED. The pixel driving system of AMOLED includes a pixel driving circuit of a 4T1C architecture, and an initialization voltage supply module electrically connected to the pixel driving circuit, by providing a high level of an initialization signal from the initialization voltage supply module at the light emission stage in the pixel driving circuit to effectively compensate the threshold voltage of the driving thin film transistor, so that the current flowing through the organic light emitting diode is stabilized while reducing the leakage current of the gate and the source of the driving thin film transistor in the light emission stage, the stability of the compensation data in the light emission stage, to enhance the compensation effect.

11 Claims, 4 Drawing Sheets

(51) Int. Cl.
*G09G 3/3233* (2016.01)
*G09G 3/3266* (2016.01)

(58) Field of Classification Search
USPC ..... 345/82
See application file for complete search history.

(56) References Cited

U.S. PATENT DOCUMENTS

2014/0084792 A1* 3/2014 Oh ..... H05B 37/02
315/120
2017/0061875 A1* 3/2017 Cho ..... G09G 3/3233

* cited by examiner

PIXEL DRIVING SYSTEM OF AMOLED HAVING INITIALIZATION SIGNAL OF ALTERNATING HIGH AND LOW LEVELS AND METHOD FOR DRIVING PIXEL OF AMOLED HAVING INITIALIZATION SIGNAL OF ALTERNATING HIGH AND LOW LEVELS

FIELD OF THE INVENTION

The present application relates to a display technology field, and more particularly to a pixel driving system of AMOLED and method for driving pixel of AMOLED.

BACKGROUND OF THE INVENTION

Organic light emitting diode, OLED display device with self-luminous, low driving voltage, high luminous efficiency, short response time, sharpness and high contrast, nearly 180° viewing angle, wide temperature range for using, realizing flexible display and large area full color display and many other advantages, is recognized as the most potential for development in the display device industry.

The OLED display devices can be divided into two types, including passive matrix OLED (PMOLED) and active matrix OLED (AMOLED) according to the driving mode, such as two types of direct addressing and Thin Film Transistor, TFT matrix addressing. Among them, AMOLED has pixels arranged in an array type that is active display type with high luminous efficiency, and usually used for high-definition large-size display device.

AMOLED is the current driving device, when a current flows through the organic light-emitting diode, the organic light-emitting diode emitting light, and the luminous brightness is decided by current flow through the organic light-emitting diode itself.

Most of the existing integrated circuit, IC transmits only voltage signals, so the driving circuit for the pixels of the AMOLED needs to complete the task of converting the voltage signal into a current signal.

Referring to FIG. 1, FIG. 1 is a circuit diagram of the pixel driving circuit of the AMOLED in the conventional technology includes: a first thin film transistor T10, a second thin film transistor T20, a third thin film transistor T30, a fourth thin film transistor T40, a capacitor C10, and an organic light emitting diode D10, a gate of the first thin film transistor T10 receives a first scanning signal Scan1, a source receives a data signal Data, a drain is electrically connected to a gate of the second thin film transistor T20, a drain of the second thin film transistor T20 receives power supply voltage OVDD, a source is electrically connected to an anode of the organic light emitting diode D10, a gate of the third thin film transistor T30 receives a second scanning signal Scan2, a source is electrically connected to the gate of the second thin film transistor T20, a drain is electrically connected to a source of the thin film transistor T40, a gate of the fourth thin film transistor T40 receives the second scanning signal Scan2, a source receives an initialization voltage Vini, a drain is electrically connected to the anode of the organic light emitting diode D10, an end of the capacitor C10 is electrically connected to the gate of the second thin film transistor T20 and the other end is electrically connected to the anode of the organic light emitting diode D10, and the cathode of the organic light emitting diode D10 is grounded. The pixel driving circuit of the AMOLED performs the four stages successively of reset, threshold voltage detection, threshold voltage compensation, and emitting light to complete the driving of pixels, to realize the compensation for the characteristic of the drift of the threshold voltage of the driving thin film transistor, i.e., the second thin film transistor T20, however, due to the initialization voltage Vini in the AMOLED pixel driving circuit is always low electrical level, so that the source voltage of the fourth thin film transistor T40 at the light emission stage is lower than the voltage of the gate and the source of the second thin film transistor T20, and then leading to the gate and the source of the second thin film transistor T20 generate a leakage current, and the presence of the leakage current causes the OLED compensation data to be drifted and the gate and source voltage of the second thin film transistor T20 are distorted to affect the compensation effect.

SUMMARY OF THE INVENTION

The object of the present application is to provide a pixel driving system of AMOLED which can effectively compensate the threshold voltage of the driving thin film transistor so that the current flowing through the organic light emitting diode is stabilized, the leakage current is reduced, the stability of the compensation data of the light emission stage is improved, and the compensation effect is improved.

The object of the present application is further to provide a pixel driving method of AMLOED that is capable of effectively compensating the threshold voltage of the driving thin film transistor, stabilizing the current flowing through the organic light emitting diode, reducing the leakage current, improving the stability of the compensation data of the light emission stage, and the compensation effect is improved.

In order to achieve the above object, a pixel driving system of AMOLED is provided in the present application including: a pixel driving circuit and an initialization voltage supply module electrically connected to the pixel driving circuit;

the pixel driving circuit including: a first thin film transistor, a second thin film transistor, a third thin film transistor, a fourth thin film transistor, a capacitor, and an organic light emitting diode;

a gate of the first thin film transistor receives a first scanning signal, a source receives a data signal, a drain is electrically connected to the first node;

a gate of the second thin film transistor is electrically connected to the first node, a drain receives a power supply voltage, a source is electrically connected to a second node;

a gate of the third thin film transistor receives a second scanning signal, a source is electrically connected to the first node; a drain is electrically connected to the third node;

a gate of the fourth thin film transistor receives the second scanning signal, a source is electrically connected to the third node, a drain is electrically connected to the second node;

one end of the capacitor is electrically connected to the first node and the other end is electrically connected to the second node;

an anode of the organic light emitting diode is electrically connected to the second node and the cathode is grounded; and the initialization voltage supply module is electrically connected to the third node, and provides an initialization signal having a high and low alternating level to the third node in time order, the high level of the initialization signal is equal to the level of the first node when the organic light emitting diode emits light or the level of the second node when the organic light emitting diode emits light or greater than the level of the first node when the organic light emitting diode emits light.

The initialization voltage supply module including: a multiplexer, an initialization high voltage generation module, and an initialization low voltage generation module; and input terminals of the multiplexer are respectively electrically connected to the initialization high voltage generation module and the initialization low voltage generation module; an output terminal is electrically connected to the third node, control terminals receive the first strobe signal and a second gating signal.

The pixel driving system of the AMOLED further including: a control signal generation module, a first scanning signal output processing module electrically connected to the control signal generation module, and a data signal output processing module electrically connected to the control signal generation module;

the control signal generation module outputs the enable signal of the first scanning signal and the driving signal of the data signal, respectively to the first scanning signal output processing module and the data signal output processing module to control the first scanning signal output processing module and the data signal output processing module output the first scanning signal and the data signal, respectively;

the first strobe signal is the enable signal of the first scanning signal, the second strobe signal is the driving signal of the data signal;

when the enable signal of the first scanning signal is at high level, the first scanning signal is at low level, when the enable signal of the first scanning signal is at low level, the first scanning signal is at high level; and when the driving signal of the data signal is at low level, the data signal is at low level, and when the driving signal of the data signal is at high level, the data signal is at high level; when the enable signal of the first scanning signal and the driving signal of the data signal are both at high level, the initialization signal is at high level, and the initialization signal is all at low level in the rest of the time.

Wherein the first scanning signal, the second scanning signal, and the data signal phase combination are timely corresponding to a reset stage, a threshold voltage detection stage, a threshold voltage compensation stage, and a light emission stage;

in the reset stage, the first scanning signal is provided with a low level, the second scanning signal is provided with a high level, the data signal is provided with a low level, and the initialization signal is provided with a low level;

in the threshold voltage detection phase, the first scanning signal is switched to the high level, the second scanning signal is switched to the low level, the data signal is maintained at low level, and the initialization signal is maintained at low level;

in the threshold voltage compensation phase, the first scanning signal is maintained at high level, the second scanning signal is maintained at low level, the data signal is switched to high level, the initialization signal is maintained at low level; and in the light emission stage, the first scanning signal is switched to the low level, and the second scanning signal is maintained at low level, the data signal is maintained at high level, the initialization signal is switched to a high level.

Wherein the low level of the data signal is greater than the low level of the initialization signal.

Wherein the control signal generation module is a Field Programmable Gate Array, FPGA.

The present application further provides a pixel driving method of the AMOLED including the steps:

step S1: providing a pixel driving system of AMOLED, including: a pixel driving circuit and an initialization voltage supply module electrically connected to the pixel driving circuit;

the pixel driving circuit including: a first thin film transistor, a second thin film transistor, a third thin film transistor, a fourth thin film transistor, a capacitor, and an organic light emitting diode;

a gate of the first thin film transistor receives a first scanning signal, a source receives a data signal, a drain is electrically connected to the first node;

a gate of the second thin film transistor is electrically connected to the first node, a drain receives a power supply voltage; a source is electrically connected to a second node;

a gate of the third thin film transistor receives a second scanning signal; a source is electrically connected to the first node, a drain is electrically connected to the third node;

a gate of the fourth thin film transistor receives the second scanning signal, a source is electrically connected to the third node, a drain is electrically connected to the second node;

one end of the capacitor is electrically connected to the first node and the other end is electrically connected to the second node;

an anode of the organic light emitting diode is electrically connected to the second node and the cathode is grounded;

the initialization voltage supply module is electrically connected to the third node, and provides an initialization signal to the third node;

step S2: entering the reset phase;

the first scanning signal is provided with a low level, the second scanning signal is provided with a high level, the data signal is provided with a low level, the initialization signal is provided with a low level, the first thin film transistor is turned off, the third and fourth thin film transistors are turned on, and the levels of the first node and the second node are equal to the low level of the initialization signal;

step S3: entering the threshold voltage detection phase;

the first scanning signal is switched to the high level, the second scanning signal is switched to the low level, the data signal is maintained at a low level, the initialization signal is maintained at a low level, and the first thin film transistor is turned on and the third and fourth thin film transistors are turned off, the level of the first node is equal to the low level of the data signal, the level of the second node is equal to the low level of the initialization signal, the low level of the data signal is greater than the low level of the initialization signal, and the capacitor starts charging;

step S4: entering the threshold voltage compensation stage;

the first scanning signal is maintained at the high level, the second scanning signal is maintained at the low level, the data signal is switched to the high level, the initialization signal is maintained at low level, the first thin film transistor is turned on, the third and fourth thin film transistors are turned off, the level of the first node is equal to the high level of the data signal, the level of the second node is equal to $Vref-Vth+\Delta V$, wherein the Vref is the low level of the data signal, Vth is the threshold voltage of the second thin film transistor, $\Delta V$ is the voltage charged to the capacitor from the threshold voltage detection stage to the threshold voltage compensation stage; and step S5: entering the light emission stage;

the first scanning signal is switched to the low level, the second scanning signal is maintained at the low level, the data signal is maintained at the high level, the initialization signal is switched to the high level, the first thin film transistor is turned off, the third and fourth thin film transistors are turned on, the organic light emitting diode emits light, and the high level of the initialization signal is equal to the level of the first node at this time, or the level of the second node at this time, or greater than the level of the first node at this time.

Wherein the initialization voltage supply module including: a multiplexer, an initialization high voltage generation module, and an initialization low voltage generation module; and input terminals of the multiplexer are respectively electrically connected to the initialization high voltage generation module and the initialization low voltage generation module; an output terminal is electrically connected to the third node, control terminals receive the first strobe signal and a second gating signal.

The pixel driving system further including: a control signal generation module, a first scanning signal output processing module electrically connected to the control signal generation module, and a data signal output processing module electrically connected to the control signal generation module;

the control signal generation module outputs the enable signal of the first scanning signal and the driving signal of the data signal, respectively to the first scanning signal output processing module and the data signal output processing module to control the first scanning signal output processing module and the data signal output processing module output the first scanning signal and the data signal, respectively;

the first strobe signal is the enable signal of the first scanning signal, the second strobe signal is the driving signal of the data signal;

when the enable signal of the first scanning signal is at high level, the first scanning signal is at low level, when the enable signal of the first scanning signal is at low level, the first scanning signal is at high level; and when the driving signal of the data signal is at low level, the data signal is at low level, and when the driving signal of the data signal is at high level, the data signal is at high level; when the enable signal of the first scanning signal and the driving signal of the data signal are both at high level, the initialization signal is at high level, and the initialization signal is all at low level in the rest of the time.

Wherein the control signal generation module is a Field Programmable Gate Array, FPGA.

The present application father provides a pixel driving system of the AMOLED, including: a pixel driving circuit and an initialization voltage supply module electrically connected to the pixel driving circuit;

the pixel driving circuit including: a first thin film transistor, a second thin film transistor, a third thin film transistor, a fourth thin film transistor; a capacitor; and an organic light emitting diode;

a gate of the first thin film transistor receives a first scanning signal, a source receives a data signal, a drain is electrically connected to the first node;

a gate of the second thin film transistor is electrically connected to the first node, a drain receives a power supply voltage; a source is electrically connected to a second node;

a gate of the third thin film transistor receives a second scanning signal, a source is electrically connected to the first node, a drain is electrically connected to the third node;

a gate of the fourth thin film transistor receives the second scanning signal, a source is electrically connected to the third node, a drain is electrically connected to the second node;

one end of the capacitor is electrically connected to the first node and the other end is electrically connected to the second node;

an anode of the organic light emitting diode is electrically connected to the second node and the cathode is grounded;

the initialization voltage supply module is electrically connected to the third node, and provides an initialization signal having a high and low alternating level to the third node in time order, the high level of the initialization signal is equal to the level of the first node when the organic light emitting diode emits light or the level of the second node when the organic light emitting diode emits light or greater than the level of the first node when the organic light emitting diode emits light;

wherein the initialization voltage supply module including: a multiplexer, an initialization high voltage generation module, and an initialization low voltage generation module;

input terminals of the multiplexer are respectively electrically connected to the initialization high voltage generation module and the initialization low voltage generation module; an output terminal is electrically connected to the third node, control terminals receive the first strobe signal and a second gating signal;

wherein the first scanning signal, the second scanning signal, and the data signal phase combination are timely corresponding to a reset stage, a threshold voltage detection stage, a threshold voltage compensation stage, and a light emission stage;

in the reset stage, the first scanning signal is provided with a low level, the second scanning signal is provided with a high level, the data signal is provided with a low level, and the initialization signal is provided with a low level;

in the threshold voltage detection phase, the first scanning signal is switched to the high level, the second scanning signal is switched to the low level, the data signal is maintained at low level, and the initialization signal is maintained at low level;

in the threshold voltage compensation phase, the first scanning signal is maintained at high level, the second scanning signal is maintained at low level, the data signal is switched to high level, the initialization signal is maintained at low level; and in the light emission stage, the first scanning signal is switched to the low level, and the second scanning signal is maintained at low level, the data signal is maintained at high level, the initialization signal is switched to a high level.

The advantageous effects of the present application: a pixel driving system of AMOLED is provided in the present application including a pixel driving circuit of a 4T1C architecture and an initialization voltage supply module electrically connected to the pixel driving circuit, by providing a high level of an initialization signal from the initialization voltage supply module at the light emission stage in the pixel driving circuit to effectively compensate the threshold voltage of the driving thin film transistor, so that the current flowing through the organic light emitting diode is stabilized while reducing the leakage current of the gate and the source of the driving thin film transistor in the light emission stage, the stability of the compensation data in the light emission stage, to enhance the compensation effect. The application also provides a pixel driving method of AMOLED capable of effectively compensating the threshold voltage of the driving thin film transistor, stabilizing the current flowing through the organic light emitting diode, improving the stability of the compensation data of the light emission stage, reducing the leakage current and improving the compensation effect.

BRIEF DESCRIPTION OF THE DRAWINGS

In order to more clearly illustrate the embodiments of the present application or prior art, the following figures will be described in the embodiments are briefly introduced.

It is obvious that the drawings are merely some embodiments of the present application, those of ordinary skill in this field can obtain other figures according to these figures without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts acquired should be considered within the scope of protection of the present application.

Specifically, the terminologies in the embodiments of the present application are merely for describing the purpose of the certain embodiment, but not to limit the invention.

Figure 1:
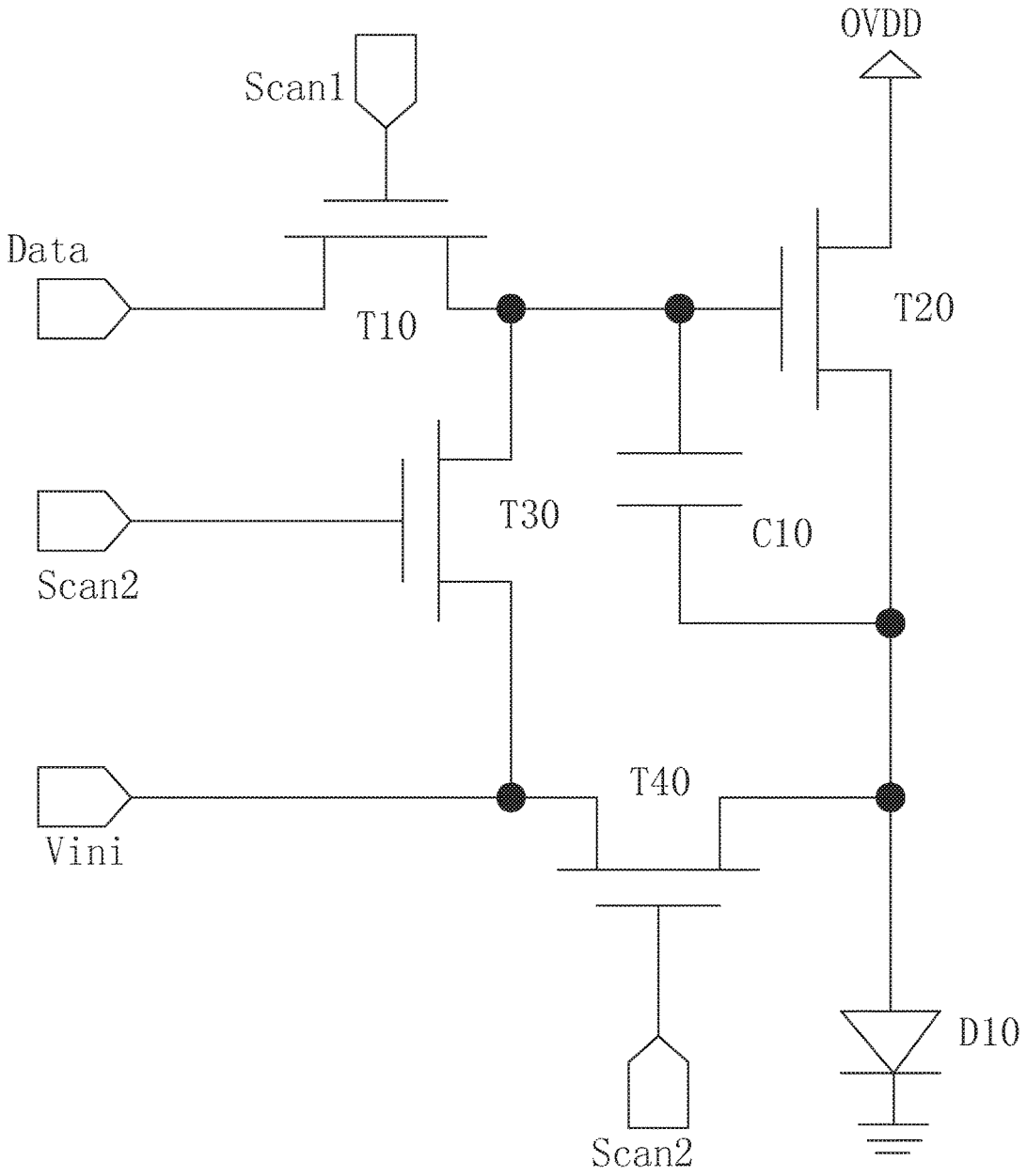
(Prior Art) Fig. 1
FIG. 1 is a circuit diagram of the pixel driving circuit of the AMOLED in the conventional technology.
Figure 2:
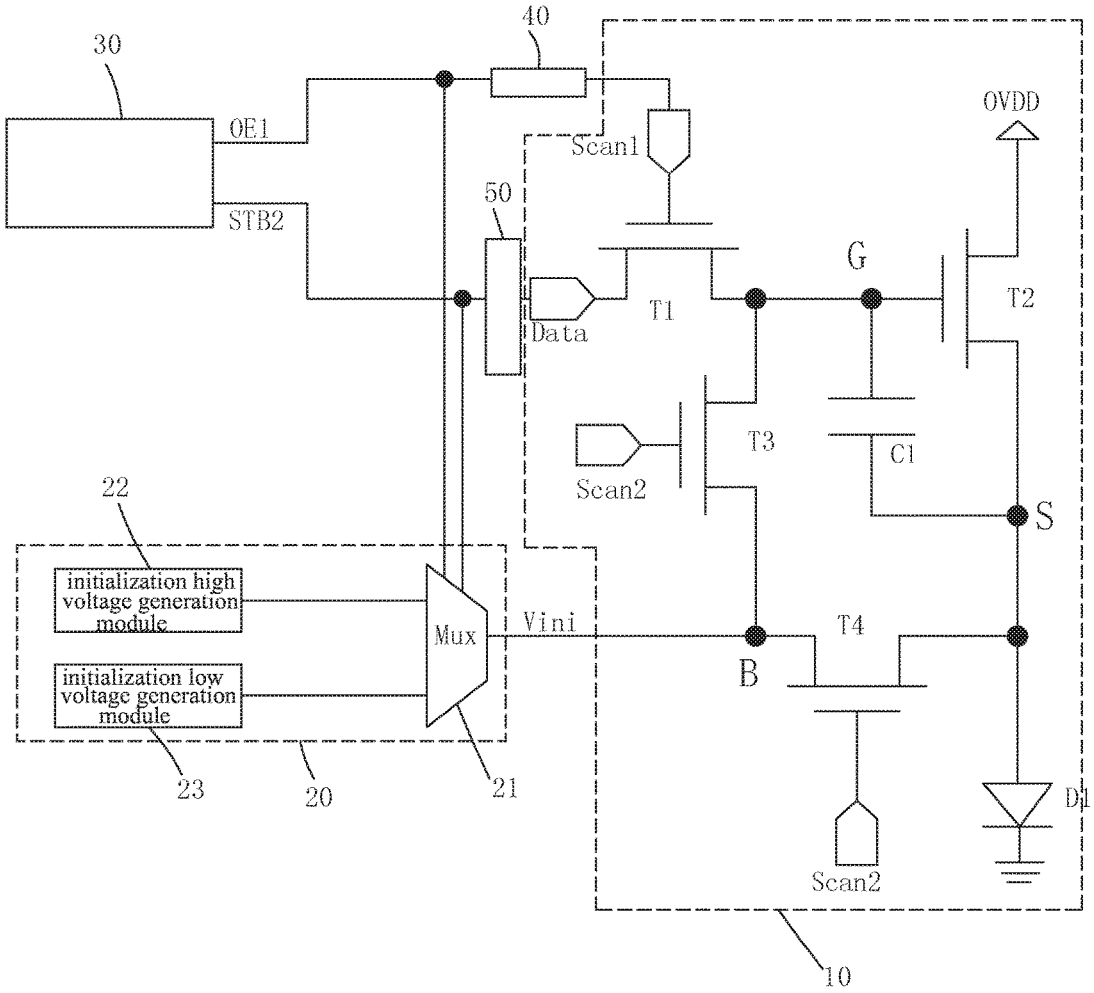
FIG. 2 is a circuit diagram of a pixel driving system of the AMOLED according the present application.

Referring to FIG. 2, FIG. 2 is a circuit diagram of a pixel driving system of the AMOLED according the present application includes a pixel driving circuit 10 and an initialization voltage supply module 20 electrically connected to the pixel driving circuit 10, The pixel driving circuit 10 includes a first thin film transistor T1, a second thin film transistor T2, a third thin film transistor T3, a fourth thin film transistor T4, a capacitor C1, and an organic light emitting diode D1;

A gate of the first thin film transistor T1 receives a first scanning signal Scan1, a source receives a data signal Data, a drain is electrically connected to the first node G, A gate of the second thin film transistor T2 is electrically connected to the first node G, a drain receives a power supply voltage OVDD, a source is electrically connected to a second node S, A gate of the third thin film transistor T3 receives a second scanning signal Scan2, a source is electrically connected to the first node G, a drain is electrically connected to the third node B, A gate of the fourth thin film transistor T4 receives the second scanning signal Scan2, a source is electrically connected to the third node B, a drain is electrically connected to the second node S;

One end of the capacitor C1 is electrically connected to the first node G and the other end is electrically connected to the second node S;

An anode of the organic light emitting diode D1 is electrically connected to the second node S and the cathode is grounded;

The initialization voltage supply module 20 is electrically connected to the second node B and provides an initialization signal Vini having a high and low alternating level to the third node B in time order.

Specifically, the first thin film transistor T1, the second thin film transistor T2, the third thin film transistor T3, and the fourth thin film transistor T4 can be selected from one of a low temperature polysilicon thin film transistor, an oxide semiconductor thin film transistor, and an amorphous silicon thin film transistor.

Specifically, the high level of the initialization signal Vini can be set equal to the level of the first node G when the organic light emitting diode D1 emits light or the level of the second node S when the organic light emitting diode D1 emits light, to reduce the voltage difference between the first node G, the second node S and the third node B when the organic light emitting diode D1 emits light, thereby reducing the leakage current between the first node G and the second node S when the organic light emitting diode D1 emits light, to ensure the accuracy of OLED compensation data and to improve the compensation effect.

Further, the high level of the initialization signal Vini can be set to be greater than the level of the first node G when the organic light emitting diode D1 emits light, and the level of the third node B is greater than the level of the first node G and greater than the level of the second node S so that the leakage current at the time when the organic light emitting diode D1 emits light is reversed, the level of the first and second nodes G, S is raised, the compensation voltage is distorted, to ensure the accuracy of OLED compensation data and to improve the compensation effect.

It should be noted that, the voltage value of the high level of the initialization signal Vini can be selected by experiments and simulation analysis to moderate adjustment the value according to different process conditions and pixel design.

Specifically, as shown in FIG. 2, the initialization voltage supply module 20 includes a multiplexer 21, an initialization high voltage generation module 22, and an initialization low voltage generation module 23;

The input terminals of the multiplexer 21 are respectively electrically connected to the initialization high voltage generation module 22 and the initialization low voltage generation module 23; output terminals are electrically connected to the third node B, control terminals receive the first strobe signal and a second gating signal, the first strobe signal and the second gating signal are capable of selecting a suitable signal as desired, by the first strobe signal and the second gating signal to control the multiplexer 21 outputs the high level generated by the initialization high voltage generation module 22 or a low level generated by the initialization low voltage generating module 23 at a corresponding period.

Further, the pixel driving system of the AMOLED further includes a control signal generation module 30, a first scanning signal output processing module 40 electrically connected to the control signal generation module 30, and a data signal output processing module 50 electrically connected to the control signal generation module 30. Preferably, the control signal generation module 30 is a Field Programmable Gate Array, FPGA.

The control signal generation module 30 outputs the enable signal OE1 of the first scanning signal Scan1 and the driving signal STB2 of the data signal Data, respectively to the first scanning signal output processing module 40 and the data signal output processing module 50 and to control the first scanning signal output processing module 40 and the data signal output processing module 50 output the first scanning signal Scan1 and the data signal Data, respectively;

At this time, the first strobe signal can be the enable signal OE1 of the first scanning signal Scan1, the second strobe signal can be the driving signal STB2 of the data signal Data; when the enable signal OE1 of the first scanning signal Scan1 is at high level, the first scanning signal Scan1 is at low level, when the enable signal OE1 of the first scanning signal Scan1 is at low level, the first scanning signal Scan1 is at high level; When the driving signal STB2 of the data signal Data is at low level, the data signal Data is at low level, and when the driving signal STB2 of the data signal Data is at high level, the data signal Data is at high level; When the enable signal OE1 of the first scanning signal Scan1 and the driving signal STB2 of the data signal Data are both at high level, the initialization signal Vini is at high level, and the initialization signal Vini is all at low level in the rest of the time.

Figure 3:
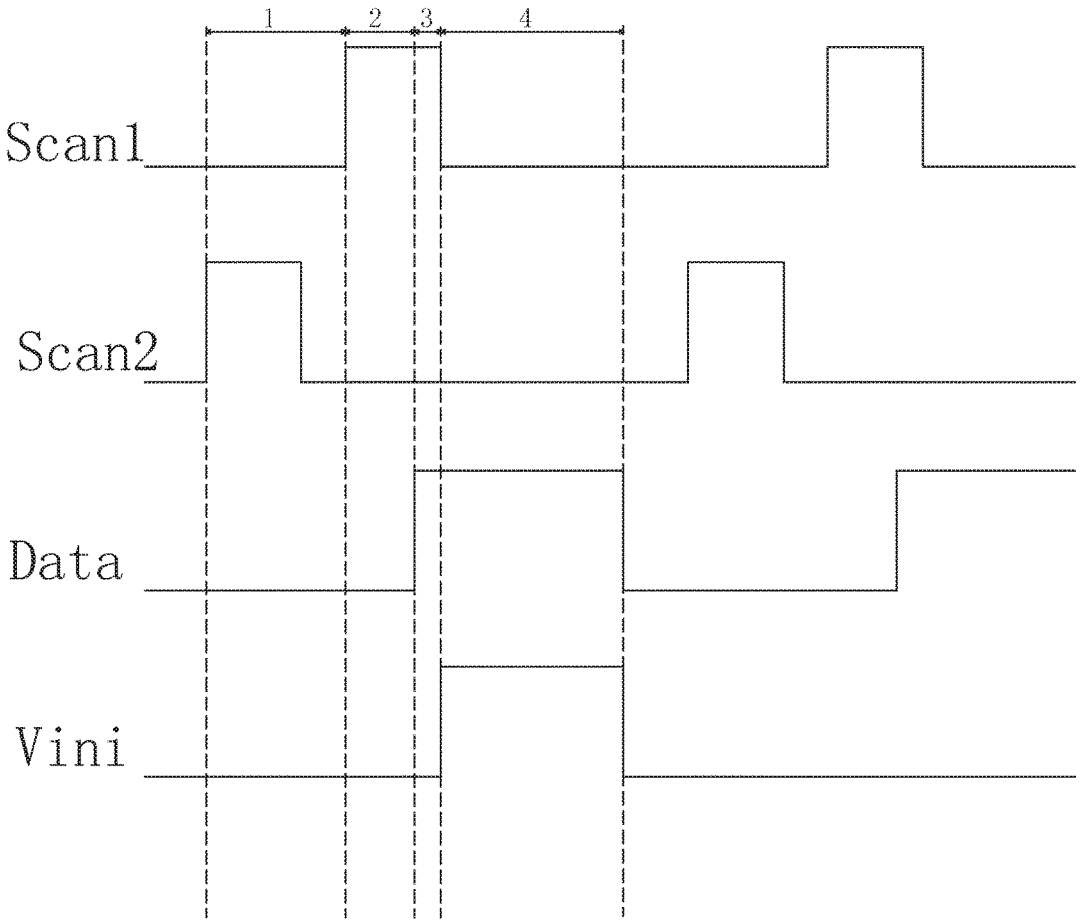
FIG. 3 is a timing diagram of the pixel driving system of the AMOLED according the present application.

Specifically, referring to FIG. 3, the operation process of the pixel driving system of AMOLED in the present application is: the first scanning signal Scan1, the second scanning signal Scan2, and the data signal Data phase combination to correspond to a reset stage 1, a threshold voltage detection stage 2, a threshold voltage compensation stage 3, and a light emission stage 4;

In the reset stage 1, the first scanning signal Scan1 is provided with a low level, the second scanning signal Scan2 is provided with a high level, the data signal Data is provided with a low level, and the initialization signal Vini provides a low level, the first thin film transistor T1 is turned off, the third and the fourth thin film transistors T3, T4 are turned on and the levels of the first node G and the second node S are equal to the low level of the initialization signal Vini; in the threshold voltage detection phase 2, the first scanning signal Scan1 is switched to the high level, the second scanning signal Scan2 is switched to the low level, the data signal Data is maintained at low level, and the initialization signal Vini is maintained at low level, the first thin film transistors T1 is turned on, the third thin film transistors T3 and the fourth thin film transistors T4 are turned off, the level of the first node G is equal to the low level of the data signal Data, and the level of the second node S is equal to the low level of the initialization signal Vini, and presetting the low level of the data signal Data is higher than the low level of the initialization signal Vini, such that the capacitor C1 starts charging at this time; and in the threshold voltage compensation phase 3, the first scanning signal Scan1 is maintained at high level, the second scanning signal Scan2 is maintained at low level, the data signal Data is switched to high level, the initialization signal Vini is maintained at low level, and the first thin film transistor T1 is turned on, the third and fourth thin film transistors T3, T4 are turned off, the level of the first node G is equal to the high level of the data signal Data, the level of the second node S is equal to $Vref-Vth+\Delta V$, where Vref is the low level of the data signal Data, Vth is the threshold voltage of the second thin film transistor T2, $\Delta V$ is the voltage charged to the capacitor C1 from the threshold voltage detection stage 2 to the threshold voltage compensation stage 3, and the gate-source voltage of the second thin film transistor T2, such as the voltage difference of the two ends of the capacitor C1 is $Vdata-Vref+Vth-\Delta V$, wherein the Vdata is the high level of the data signal Data; in the light emission stage 4, the first scanning signal Scan1 is switched to the low level, and the second scanning signal Scan2 is maintained at low level, the data signal Data is maintained at high level, the initialization signal Vini is switched to a high level, the first thin film transistor T1 is turned off, the third and fourth thin film transistors T3, T4 are turned on, the organic light emitting diode D1 emitting light, the high level of the initialization signal Vini is equal to the level of the first node G at this time or equal to the level of the second node S at this time, or greater than the level of the first node G at this time.

It is worth mentioning that, in the light emission stage 4, because of the storage effect of capacitor C1, the voltage difference of the two ends of the capacitor C1 such as the gate-source voltage of the second thin film transistor T2 is not changed and still $Vdata-Vref+Vth-\Delta V$, the driving current flowing through the organic light emitting diode D1 is $I=K(Vdata-Vref-\Delta V)^2$, K is the structural parameter of the thin film transistor, and the K value is relatively stable for the thin film transistor with the same structure, it can be known from the driving current expression, the driving current is not related to the threshold voltage Vth of the second thin film transistor T2, thus eliminating the influence from the threshold voltage Vth, to enhance the consistency and stability of the organic light emitting diode current, and improve the display quality of the organic light emitting diode, at the same time, the initialization signal Vini is provided with a high level, such that the level of the third node B is equal to the level of the first node G at this time, or equal to the level of the second node S at this time, or greater than the level of the first node G at this time, the leakage current of the gate and the source of the driving thin film transistor, such as the second thin film transistor T2 is inhibited or the leakage current is reversed, thereby compensating or alleviating the compensation data voltage distortion due to the leakage current, improving the stability of the compensation data in the light emission phase, and improving the compensation effect of the pixel driving circuit.

Figure 4:
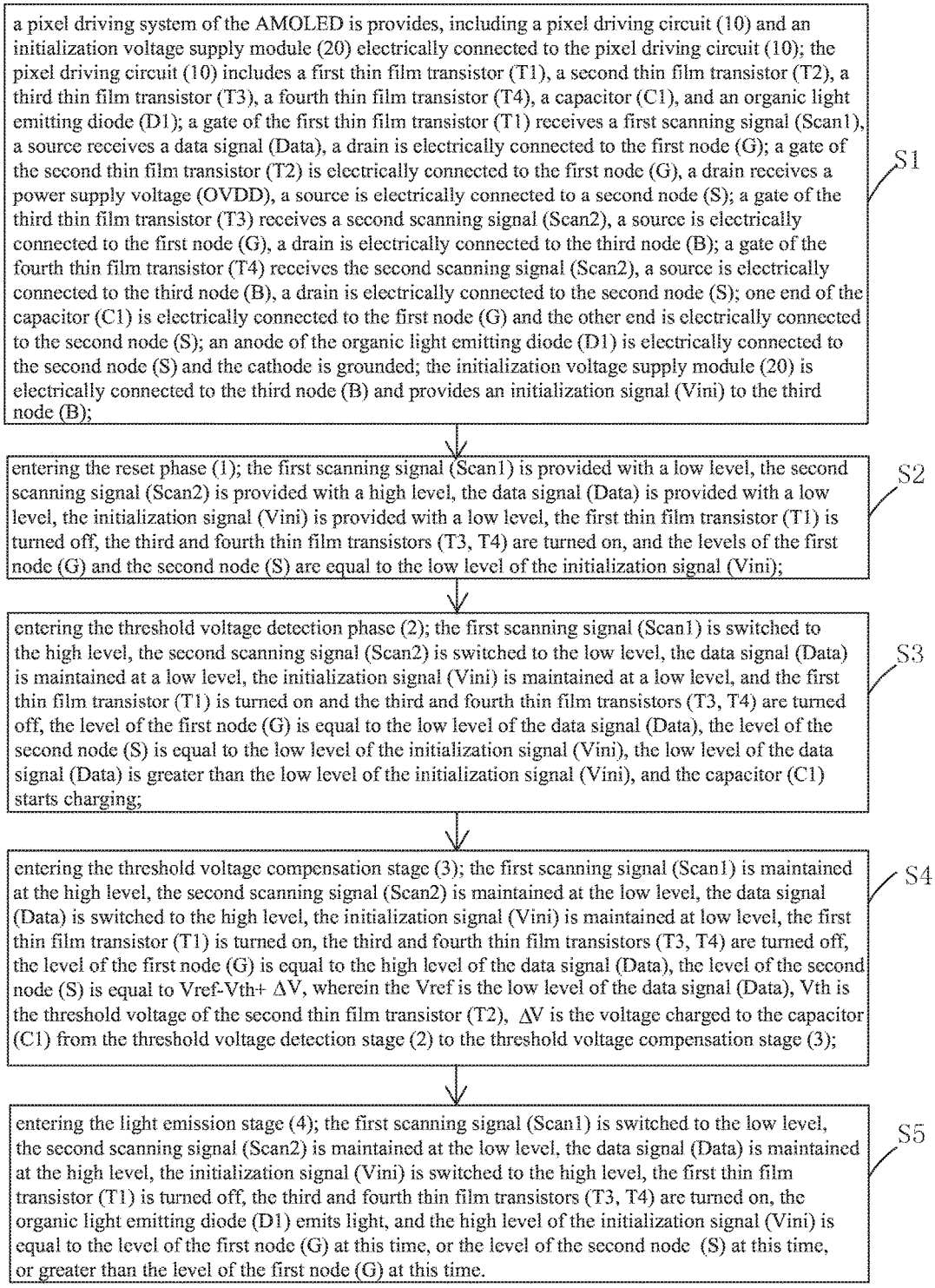
FIG. 4 is a flowchart of a pixel driving method of the AMOLED according to the present application.

Referring to FIG. 4, and also referring to FIG. 3, the present application also provides a pixel driving method of the AMOLED includes the following steps:

Step S1: providing a pixel driving system of AMOLED as shown in FIG. 2, wherein the system is no longer described repeatedly here;

Step S2: entering the reset phase 1;

The first scanning signal Scan1 is provided with a low level, the second scanning signal Scan2 is provided with a high level, the data signal Data is provided with a low level, the initialization signal Vini is provided with a low level, the first thin film transistor T1 is turned off, the third and fourth thin film transistors T3, T4 are turned on, and the levels of the first node G and the second node S are equal to the low level of the initialization signal Vini;

Step S3: entering the threshold voltage detection phase 2;

The first scanning signal Scan1 is switched to the high level, the second scanning signal Scan2 is switched to the low level, the data signal Data is maintained at a low level, the initialization signal Vini is maintained at a low level, and the first thin film transistor T1 is turned on and the third and fourth thin film transistors T3 and T4 are turned off, the level of the first node G is equal to the low level of the data signal Data, the level of the second node S is equal to the low level of the initialization signal Vini, the low level of the data signal Data is greater than the low level of the initialization signal Vini, and the capacitor C1 starts charging;

Step S4: entering the threshold voltage compensation stage 3;

The first scanning signal Scan1 is maintained at the high level, the second scanning signal Scan2 is maintained at the low level, the data signal Data is switched to the high level, the initialization signal Vini is maintained at low level, the first thin film transistor T1 is turned on, the third and fourth thin film transistors T3, T4 are turned off, the level of the first node G is equal to the high level of the data signal Data, the level of the second node S is equal to Vref-Vth+A V, wherein the Vref is the low level of the data signal Data, Vth is the threshold voltage of the second thin film transistor T2, ΔV is the voltage charged to the capacitor C1 from the threshold voltage detection stage 2 to the threshold voltage compensation stage 3, the gate-source voltage of the second thin film transistor T2 is Vdata−Vref+Vth−ΔV, wherein the Vdata is the high level of the data signal Data;

Step S5: entering the light emission stage 4;

The first scanning signal Scan1 is switched to the low level, the second scanning signal Scan2 is maintained at the low level, the data signal Data is maintained at the high level, the initialization signal Vini is switched to the high level, the first thin film transistor T1 is turned off, the third and fourth thin film transistors T3 and T4 are turned on, the organic light emitting diode D1 emits light, and the high level of the initialization signal Vini is equal to the level of the first node G at this time, or the level of the second node S at this time, or greater than the level of the first node G at this time.

Specifically, in the light emission stage 4, because of the storage effect of capacitor C1, the voltage difference of the two ends of the capacitor C1 such as the gate-source voltage of the second thin film transistor T2 is not changed and is still Vdata−Vref+Vth−ΔV, the driving current flowing through the organic light emitting diode D1 is $I=K(Vdata-Vref-\Delta V)^2$, K is the structural parameter of the thin film transistor, and the K value is relatively stable for the thin film transistor with the same structure, it can be known from the driving current expression, the driving current is not related to the threshold voltage Vth of the second thin film transistor T2, thus eliminating the influence from the threshold voltage Vth, to enhance the consistency and stability of the organic light emitting diode current, and improve the display quality of the organic light emitting diode, at the same time, the initialization signal Vini is provided with a high level, such that the level of the third node B is equal to the level of the first node G at this time, or equal to the level of the second node S at this time, or greater than the level of the first node G at this time, the leakage current of the gate and the source of the driving thin film transistor, such as the second thin film transistor T2 is inhibited or the leakage current is reversed, thereby compensating or alleviating the compensation data voltage distortion due to the leakage current, improving the stability of the compensation data in the light emission phase, and improving the compensation effect of the pixel driving circuit.

Specifically, as shown in FIG. 2, the initialization voltage supply module 20 includes a multiplexer 21, an initialization high voltage generation module 22, and an initialization low voltage generation module 23, The input terminals of the multiplexer 21 are respectively electrically connected to the initialization high voltage generation module 22 and the initialization low voltage generation module 23; the output terminals are electrically connected to the third node B, the control terminals receive the first strobe signal and a second gating signal, the first strobe signal and the second gating signal are capable of selecting a suitable signal as desired, by the first strobe signal and the second gating signal to control the multiplexer 21 outputs the high level generated by the initialization high voltage generation module 22 or a low level generated by the initialization low voltage generating module 23 at a corresponding period.

Further, the pixel driving system of the AMOLED further includes the control signal generation module 30, the first scanning signal output processing module 40 electrically connected to the control signal generation module 30, and the data signal output processing module 50 electrically connected to the control signal generation module 30. Preferably, the control signal generation module 30 is a Field Programmable Gate Array, FPGA.

The control signal generation module 30 outputs the enable signal OE1 of the first scanning signal Scan1 and the driving signal STB2 of the data signal Data, respectively to the first scanning signal output processing module 40 and the data signal output processing module 50 and to control the first scanning signal output processing module 40 and the data signal output processing module 50 output the first scanning signal Scan1 and the data signal Data, respectively;

At this time, the first strobe signal can be the enable signal OE1 of the first scanning signal Scan1, the second strobe signal can be the driving signal STB2 of the data signal Data; when the enable signal OE1 of the first scanning signal Scan1 is at high level, the first scanning signal Scan1 is at low level, when the enable signal OE1 of the first scanning signal Scan1 is at low level, the first scanning signal Scan1 is at high level; When the driving signal STB2 of the data signal Data is at low level, the data signal Data is at low level, and when the driving signal STB2 of the data signal Data is at high level, the data signal Data is at high level; When the enable signal OE1 of the first scanning signal Scan1 and the driving signal STB2 of the data signal Data are both at high level, the initialization signal Vini is at high level, and the initialization signal Vini is all at low level in the rest of the time.

In view of the above, the present application provides a pixel driving system of AMOLED including a pixel driving circuit of a 4T1C architecture, and an initialization voltage supply module electrically connected to the pixel driving circuit, by providing a high level of an initialization signal from the initialization voltage supply module at the light emission stage in the pixel driving circuit to effectively compensate the threshold voltage of the driving thin film transistor, so that the current flowing through the organic light emitting diode is stabilized while reducing the leakage current of the gate and the source of the driving thin film transistor in the light emission stage, the stability of the compensation data in the light emission stage, to enhance the compensation effect. The application also provides a pixel driving method of AMOLED capable of effectively compensating the threshold voltage of the driving thin film transistor, stabilizing the current flowing through the organic light emitting diode, improving the stability of the compensation data of the light emission stage, reducing the leakage current and improving the compensation effect.

Above are embodiments of the present application, which does not limit the scope of the present application. Any modifications, equivalent replacements or improvements within the spirit and principles of the embodiment described above should be covered by the protected scope of the invention.

What is claimed is:

1. A pixel driving system of an organic light emitting display (AMOLED), comprising: a pixel driving circuit and an initialization voltage supply module electrically connected to the pixel driving circuit;

the pixel driving circuit comprising: a first thin film transistor, a second thin film transistor, a third thin film transistor, a fourth thin film transistor, a capacitor, and an organic light emitting diode;

a gate of the first thin film transistor receives a first scanning signal, a source receives a data signal, a drain is electrically connected to the first node;

a gate of the second thin film transistor is electrically connected to the first node, a drain receives a power supply voltage, a source is electrically connected to a second node;

a gate of the third thin film transistor receives a second scanning signal, a source is electrically connected to the first node, a drain is electrically connected to the third node;

a gate of the fourth thin film transistor receives the second scanning signal, a source is electrically connected to the third node, a drain is electrically connected to the second node;

one end of the capacitor is electrically connected to the first node and the other end is electrically connected to the second node;

an anode of the organic light emitting diode is electrically connected to the second node and the cathode is grounded; and the initialization voltage supply module is electrically connected to the third node, and provides an initialization signal having a high and low alternating level to the third node in time order, the high level of the initialization signal is equal to the level of the first node when the organic light emitting diode emits light or the level of the second node when the organic light emitting diode emits light or greater than the level of the first node when the organic light emitting diode emits light;

wherein the initialization voltage supply module comprises: a multiplexer, an initialization high voltage generation module, and an initialization low voltage generation module; and input terminals of the multiplexer are respectively electrically connected to the initialization high voltage generation module and the initialization low voltage generation module; an output terminal is electrically connected to the third node, control terminals receive the first strobe signal and a second gating signal; and further comprising: a control signal generation module, a first scanning signal output processing module electrically connected to the control signal generation module, and a data signal output processing module electrically connected to the control signal generation module;

the control signal generation module outputs the enable signal of the first scanning signal and the driving signal of the data signal, respectively to the first scanning signal output processing module and the data signal output processing module to control the first scanning signal output processing module and the data signal output processing module output the first scanning signal and the data signal, respectively;

the first strobe signal is the enable signal of the first scanning signal, the second strobe signal is the driving signal of the data signal;

when the enable signal of the first scanning signal is at high level, the first scanning signal is at low level, when the enable signal of the first scanning signal is at low level, the first scanning signal is at high level; and when the driving signal of the data signal is at low level, the data signal is at low level, and when the driving signal of the data signal is at high level, the data signal is at high level; when the enable signal of the first scanning signal and the driving signal of the data signal are both at high level, the initialization signal is at high level, and the initialization signal is all at low level in the rest of the time.

2. The pixel driving system of the AMOLED according to claim 1, wherein the first scanning signal, the second scanning signal, and the data signal phase combination are timely corresponding to a reset stage, a threshold voltage detection stage, a threshold voltage compensation stage, and a light emission stage;

in the reset stage, the first scanning signal is provided with a low level, the second scanning signal is provided with a high level, the data signal is provided with a low level, and the initialization signal is provided with a low level;

in the threshold voltage detection phase, the first scanning signal is switched to the high level, the second scanning signal is switched to the low level, the data signal is maintained at low level, and the initialization signal is maintained at low level;

in the threshold voltage compensation phase, the first scanning signal is maintained at high level, the second scanning signal is maintained at low level, the data signal is switched to high level, the initialization signal is maintained at low level; and in the light emission stage, the first scanning signal is switched to the low level, and the second scanning signal is maintained at low level, the data signal is maintained at high level, the initialization signal is switched to a high level.

3. The pixel driving system of the AMOLED according to claim 2, wherein the low level of the data signal is greater than the low level of the initialization signal.

4. The pixel driving system of the AMOLED according to claim 1, wherein the control signal generation module is a Field Programmable Gate Array, FPGA.

5. A pixel driving method of an organic light emitting display (AMOLED), comprising the following steps:

step S1: providing a pixel driving system of AMOLED, comprising: a pixel driving circuit and an initialization voltage supply module electrically connected to the pixel driving circuit;

the pixel driving circuit comprising: a first thin film transistor, a second thin film transistor, a third thin film transistor, a fourth thin film transistor, a capacitor, and an organic light emitting diode;

a gate of the first thin film transistor receives a first scanning signal, a source receives a data signal, a drain is electrically connected to the first node;

a gate of the second thin film transistor is electrically connected to the first node, a drain receives a power supply voltage, a source is electrically connected to a second node;

a gate of the third thin film transistor receives a second scanning signal, a source is electrically connected to the first node, a drain is electrically connected to the third node;

a gate of the fourth thin film transistor receives the second scanning signal, a source is electrically connected to the third node, a drain is electrically connected to the second node;

one end of the capacitor is electrically connected to the first node and the other end is electrically connected to the second node;

an anode of the organic light emitting diode is electrically connected to the second node and the cathode is grounded;

the initialization voltage supply module is electrically connected to the third node, and provides an initialization signal to the third node;

step S2: entering a reset phase;

the first scanning signal is provided with a low level, the second scanning signal is provided with a high level, the data signal is provided with a low level, the initialization signal is provided with a low level, the first thin film transistor is turned off, the third and fourth thin film transistors are turned on, and the levels of the first node and the second node are equal to the low level of the initialization signal;

step S3: entering a threshold voltage detection phase;

the first scanning signal is switched to the high level, the second scanning signal is switched to the low level, the data signal is maintained at a low level, the initialization signal is maintained at a low level, and the first thin film transistor is turned on and the third and fourth thin film transistors are turned off, the level of the first node is equal to the low level of the data signal, the level of the second node is equal to the low level of the initialization signal, the low level of the data signal is greater than the low level of the initialization signal, and the capacitor starts charging;

step S4: entering a threshold voltage compensation stage;

the first scanning signal is maintained at the high level, the second scanning signal is maintained at the low level, the data signal is switched to the high level, the initialization signal is maintained at low level, the first thin film transistor is turned on, the third and fourth thin film transistors are turned off, the level of the first node is equal to the high level of the data signal, the level of the second node is equal to $Vref-Vth+\Delta V$, wherein the Vref is the low level of the data signal, Vth is the threshold voltage of the second thin film transistor, $\Delta V$ is the voltage charged to the capacitor from the threshold voltage detection stage to the threshold voltage compensation stage; and step S5: entering a light emission stage;

the first scanning signal is switched to the low level, the second scanning signal is maintained at the low level, the data signal is maintained at the high level, the initialization signal is switched to the high level, the first thin film transistor is turned off, the third and fourth thin film transistors are turned off, the organic light emitting diode emits light, and the high level of the initialization signal is equal to the level of the first node at this time, or the level of the second node at this time, or greater than the level of the first node at this time.

6. The pixel driving method of the AMOLED according to claim 5, wherein the initialization voltage supply module comprising: a multiplexer, an initialization high voltage generation module, and an initialization low voltage generation module; and input terminals of the multiplexer are respectively electrically connected to the initialization high voltage generation module and the initialization low voltage generation module; an output terminal is electrically connected to the third node, control terminals receive the first strobe signal and a second gating signal.

7. The pixel driving method of the AMOLED according to claim 6, wherein the a pixel driving system of AMOLED further comprising: a control signal generation module, a first scanning signal output processing module electrically connected to the control signal generation module, and a data signal output processing module electrically connected to the control signal generation module;

the control signal generation module outputs the enable signal of the first scanning signal and the driving signal of the data signal, respectively to the first scanning signal output processing module and the data signal output processing module to control the first scanning signal output processing module and the data signal output processing module output the first scanning signal and the data signal, respectively;

the first strobe signal is the enable signal of the first scanning signal, the second strobe signal is the driving signal of the data signal;

when the enable signal of the first scanning signal is at high level, the first scanning signal is at low level, when the enable signal of the first scanning signal is at low level, the first scanning signal is at high level; and when the driving signal of the data signal is at low level, the data signal is at low level, and when the driving signal of the data signal is at high level, the data signal is at high level; when the enable signal of the first scanning signal and the driving signal of the data signal are both at high level, the initialization signal is at high level, and the initialization signal is all at low level in the rest of the time.

8. The pixel driving method of the AMOLED according to claim 7, wherein the control signal generation module is a Field Programmable Gate Array, FPGA.

9. A pixel driving system of an organic light emitting display (AMOLED), comprising: a pixel driving circuit and an initialization voltage supply module electrically connected to the pixel driving circuit;

the pixel driving circuit comprising: a first thin film transistor, a second thin film transistor, a third thin film transistor, a fourth thin film transistor, a capacitor, and an organic light emitting diode;

a gate of the first thin film transistor receives a first scanning signal, a source receives a data signal, a drain is electrically connected to the first node;

a gate of the second thin film transistor is electrically connected to the first node, a drain receives a power supply voltage, a source is electrically connected to a second node;

a gate of the third thin film transistor receives a second scanning signal, a source is electrically connected to the first node, a drain is electrically connected to the third node;

a gate of the fourth thin film transistor receives the second scanning signal, a source is electrically connected to the third node, a drain is electrically connected to the second node;

one end of the capacitor is electrically connected to the first node and the other end is electrically connected to the second node;

an anode of the organic light emitting diode is electrically connected to the second node and the cathode is grounded;

the initialization voltage supply module is electrically connected to the third node, and provides an initialization signal having a high and low alternating level to the third node in time order, the high level of the initialization signal is equal to the level of the first node when the organic light emitting diode emits light or the level of the second node when the organic light emitting diode emits light or greater than the level of the first node when the organic light emitting diode emits light;

wherein the initialization voltage supply module comprises: a multiplexer, an initialization high voltage generation module, and an initialization low voltage generation module;

input terminals of the multiplexer are respectively electrically connected to the initialization high voltage generation module and the initialization low voltage generation module; an output terminal is electrically connected to the third node, control terminals receive the first strobe signal and a second gating signal;

wherein the first scanning signal, the second scanning signal, and the data signal phase combination are timely corresponding to a reset stage, a threshold voltage detection stage, a threshold voltage compensation stage, and a light emission stage;

in the reset stage, the first scanning signal is provided with a low level, the second scanning signal is provided with a high level, the data signal is provided with a low level, and the initialization signal is provided with a low level;

in the threshold voltage detection phase, the first scanning signal is switched to the high level, the second scanning signal is switched to the low level, the data signal is maintained at low level, and the initialization signal is maintained at low level;

in the threshold voltage compensation phase, the first scanning signal is maintained at high level, the second scanning signal is maintained at low level, the data signal is switched to high level, the initialization signal is maintained at low level; and in the light emission stage, the first scanning signal is switched to the low level, and the second scanning signal is maintained at low level, the data signal is maintained at high level, the initialization signal is switched to a high level;

further comprising: a control signal generation module, a first scanning signal output processing module electrically connected to the control signal generation module, and a data signal output processing module electrically connected to the control signal generation module;

the control signal generation module outputs the enable signal of the first scanning signal and the driving signal of the data signal, respectively to the first scanning signal output processing module and the data signal output processing module to control the first scanning signal output processing module and the data signal output processing module output the first scanning signal and the data signal, respectively;

the first strobe signal is the enable signal of the first scanning signal, the second strobe signal is the driving signal of the data signal;

when the enable signal of the first scanning signal is at high level, the first scanning signal is at low level, when the enable signal of the first scanning signal is at low level, the first scanning signal is at high level; and when the driving signal of the data signal is at low level, the data signal is at low level, and when the driving signal of the data signal is at high level, the data signal is at high level; when the enable signal of the first scanning signal and the driving signal of the data signal are both at high level, the initialization signal is at high level, and the initialization signal is all at low level in the rest of the time.

10. The pixel driving system of the AMOLED according to claim 9, wherein the low level of the data signal is greater than the low level of the initialization signal.

11. The pixel driving system of the AMOLED according to claim 9, wherein the control signal generation module is a Field Programmable Gate Array, FPGA.

* * * * *